US007756451B2

(12) United States Patent
Daigo et al.

(10) Patent No.: US 7,756,451 B2
(45) Date of Patent: Jul. 13, 2010

(54) ROTARY MOUNTING STRUCTURE FOR TONER CARTRIDGE

(75) Inventors: Hironori Daigo, Osaka (JP); Koji Murata, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 12/403,379

(22) Filed: Mar. 13, 2009

(65) Prior Publication Data

US 2009/0169268 A1 Jul. 2, 2009

Related U.S. Application Data

(63) Continuation of application No. 11/258,107, filed on Oct. 26, 2005, now Pat. No. 7,256,237.

(51) Int. Cl.
*G03G 15/08* (2006.01)

(52) U.S. Cl. ..... 399/263

(58) Field of Classification Search ..... 399/256, 399/258, 262, 263

See application file for complete search history.

(56) References Cited

U.S. PATENT DOCUMENTS

| | | | |
|---|---|---|---|
| 5,489,976 | A | 2/1996 | Ichikawa |
| 5,715,502 | A | 2/1998 | Taniguchi et al. |
| 6,049,685 | A | 4/2000 | Murakami et al. |
| 6,137,972 | A | 10/2000 | Playfair et al. |
| 6,246,854 | B1 | 6/2001 | Kurosawa et al. |

FOREIGN PATENT DOCUMENTS

| | | | |
|---|---|---|---|
| JP | H04-199077 | A | 7/1992 |
| JP | 2002-40785 | A | 2/2002 |

*Primary Examiner*—David M Gray
*Assistant Examiner*—Ruth N Labombard
(74) *Attorney, Agent, or Firm*—Shinjyu Global IP

(57) ABSTRACT

A toner cartridge comprising a rotary 2 provided with an agitator 3 that agitates a toner, and a bearing that rotatably supports a shaft tip 6 of the rotary 2, comprises a retainer 10 at the shaft tip 6 of the rotary 2 and at the bearing 7 that inhibits the slipping out, in the axial direction, of the shaft tip 6 of the rotary 2 from the bearing 7.

16 Claims, 4 Drawing Sheets

ROTARY MOUNTING STRUCTURE FOR TONER CARTRIDGE

CROSS-REFERENCE TO RELATED APPLICATIONS

This application is a continuing application of U.S. patent application Ser. No. 11/258,107 filed on Oct. 26, 2005. The entire disclosure of U.S. patent application Ser. No. 11/258,107 is hereby incorporated herein by reference.

FIELD OF THE INVENTION

The present invention relates to a toner cartridge comprising a rotary, which is provided with an agitator that agitates a toner, and a bearing that rotatably supports a shaft tip of the rotary.

BACKGROUND INFORMATION

A toner cartridge used in an image forming device, such as a copying machine, a facsimile machine, and a printer, generally comprises a rotary provided with a plate shaped agitator that agitates a toner, a rotary provided with a transporter for transporting the toner, and the like.

When these rotaries are fixed to the toner cartridge, a shaft tip on the drive side of the rotary, which is the left side end depicted in FIG. 1, is supported by a pivot at the outer side of the toner cartridge, and the other shaft tip, which is the right side end depicted in FIG. 1, is supported by insertion into a pocket shaped bearing formed inside the toner cartridge in a surface opposite the pivot. Furthermore, the rotary generally comprises a flexible member, such as a soft resin, and the mounting of the rotary inside the toner cartridge is performed by inserting the shaft tip of the rotary into the bearing while flexing the rotary.

Nevertheless, there is a risk that the shaft tip of the rotary will completely detach from the bearing on the non-drive side when an external force, such as a shock caused by a drop, acts to flex the rotary, because the rotary of a conventional device comprises a flexible member and its mounting to the toner cartridge is constituted by simply inserting the shaft tip of the rotary into the bearing. In particular, if the rotary is provided with a plate shaped agitator, then the rotary is easily flexed by the pressing of the weight of the toner upon the agitator, which is a problem because the shaft tip of the rotary can easily detach from the bearing. In addition, in the case of a large capacity toner cartridge, the rotary is long in the axial direction, which increases the play in the bearing on the non-drive side, and, consequently, the shaft tip of the rotary easily detaches from the bearing.

In view of the above, it will be apparent to those skilled in the art from this disclosure that there exists a need for a toner cartridge that has a simple constitution, a low cost, and wherein the shaft tip of the rotary does not detach from the bearing even if an external force is exerted. This invention addresses this need in the art as well as other needs, which will become apparent to those skilled in the art from this disclosure.

SUMMARY OF THE INVENTION

The characteristic constitution of the toner cartridge according to the present invention for achieving these objects is a toner cartridge comprising a rotary provided with an agitator that agitates a toner, and a bearing that rotatably supports a shaft tip of the rotary, comprising a retainer at the shaft tip of the rotary and at the bearing that inhibits the slipping out, in the axial direction, of the shaft tip of the rotary from the bearing.

Namely, according to the above characteristic constitution, a retainer is formed at the shaft tip of the rotary and the bearing, and a toner cartridge can therefore be obtained wherein the shaft tip of the rotary does not easily detach from the bearing. Furthermore, because the retainer is formed at the shaft tip of the rotary and the bearing without the addition of new parts, the toner cartridge according to the present invention can be manufactured at a low cost and without increasing the part count or adversely impacting the ease of assembly.

Another characteristic constitution of the toner cartridge according to the present invention is a toner cartridge comprising a rotary provided with an agitator that agitates a toner, and a bearing that rotatably supports a shaft tip of the rotary, wherein the rotary comprises an engager formed in a hook shape at the shaft tip; and the bearing is formed capable of engaging the engager in the state wherein the engager is compressed and deformed, and has a retainer that inhibits the slipping out of the engager in the axial direction in the normal state.

Namely, according to the above characteristic constitution, the engager formed in a hook is elastically deformed inwardly, the rotary is rotatably supported by the bearing, and then the engager is fixed to the retainer by the restoring force of the engager itself, and it is therefore possible to effectively inhibit the slipping out of the rotary from the bearing. In addition, because the engager is provided at the shaft tip of the rotary, it can be made so that the rotary does not detach from the bearing by just the addition of a slight shape modification to the conventional rotary, and there is no adverse impact on the ease of assembly. In addition, a high fixing accuracy can be obtained with such a constitution.

Furthermore, in another characteristic constitution, the rotary comprises the plate shaped agitator that extends in the axial direction of the rotary shaft; and the agitator is disposed so that it disperses [toner] in the axial direction and is connected and supported by the rotary shaft via a plate shaped supporter provided orthogonal to the axial direction.

In other words, according to the above characteristic constitution, a plate shaped agitator is provided whereupon the weight of the toner easily acts, and it is therefore possible to reliably inhibit the slipping out of the shaft tip of the rotary from the bearing by the application of the present invention to a rotary that easily detaches from the bearing.

These and other objects, features, aspects and advantages of the present invention will become apparent to those skilled in the art from the following detailed description, which, taken in conjunction with the annexed drawings, disclosed in example embodiments of the present invention.

BRIEF DESCRIPTION OF THE DRAWINGS

Referring now to the attached drawings which form a part of this original disclosure.

DETAILED DESCRIPTION OF EXAMPLE EMBODIMENTS

Figure 1:
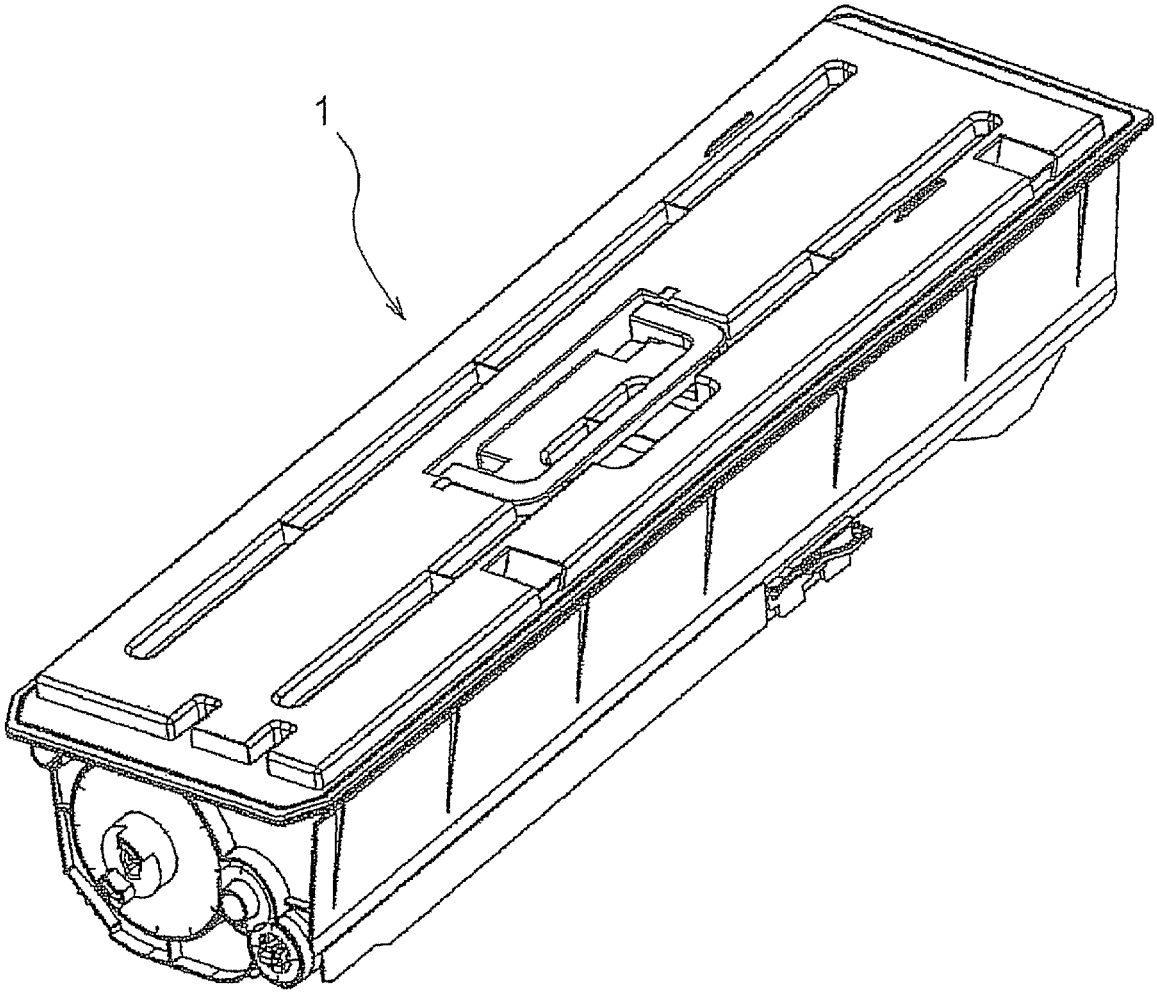
FIG. 1 is an oblique view of a toner cartridge according to the present invention.
Figure 2:
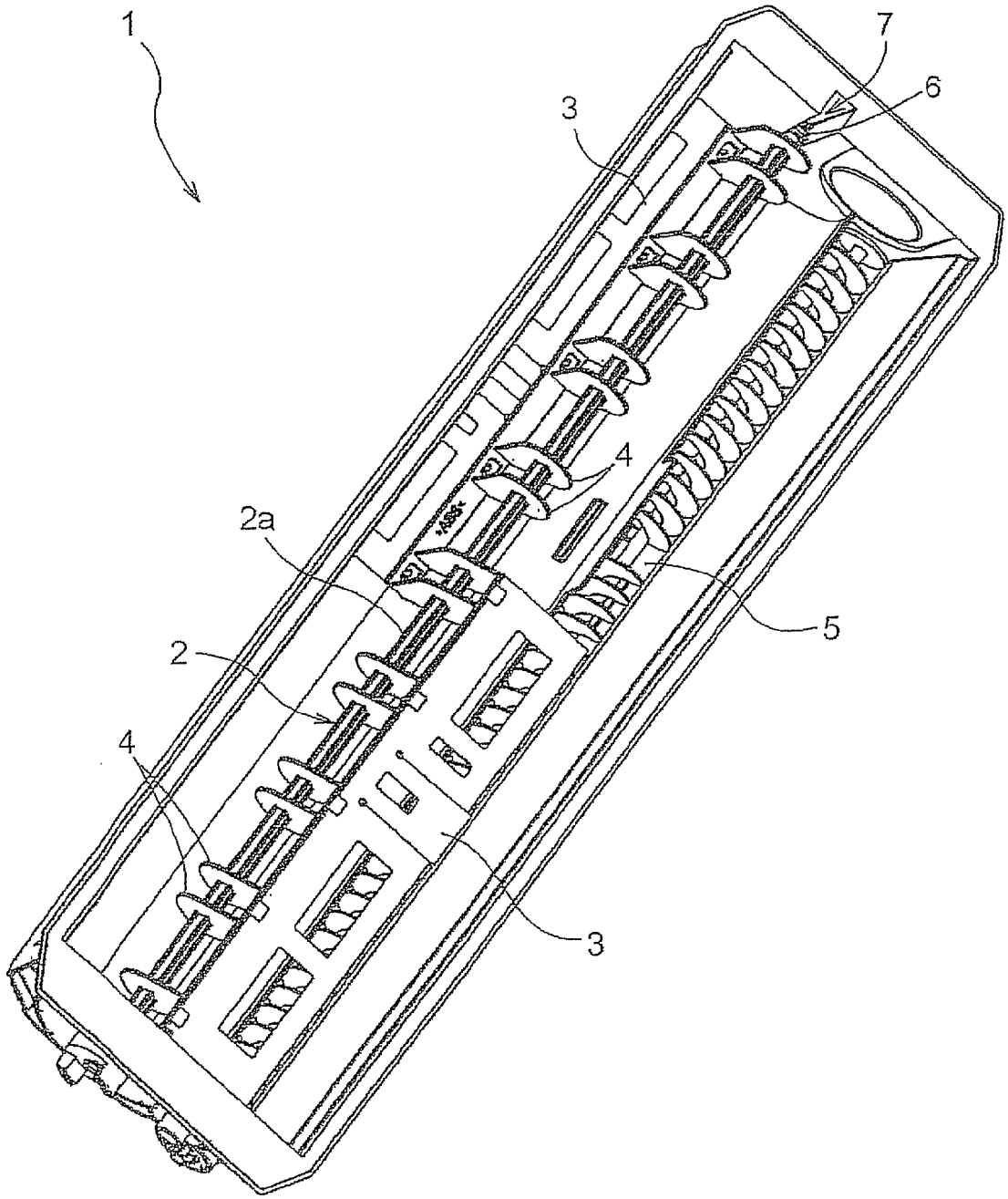
FIG. 2 is an internal structural drawing of a state wherein a cover of the toner cartridge according to the present invention is detached.

The following explains the first embodiment of a toner cartridge according to the present invention, referencing FIG. 1 through FIG. 4. FIG. 1 is a view of the entirety of a toner cartridge 1 according to the present invention, which is used in an image forming device, e.g., a copying machine, a facsimile machine, a printer, and the like. The toner cartridge 1 comprises, inside the main body thereof, a rotary 2 provided with an agitator 3 that agitates a toner, and a bearing 7 that rotatably supports a shaft end 6 of the rotary 2 on the non-drive side thereof, as depicted in FIG. 2. Furthermore, the near side in FIG. 1 is the drive side [of the rotary 2], and the far side is the non-drive side, wherein the bearing 7, which is the subject of the present application, is positioned. Furthermore, the toner cartridge 1 comprises a pivot that supports one end of a rotary shaft 2*a* of the rotary 2 in an outwardly extended state at a surface opposing the bearing 7, i.e., on the drive side. In addition, the toner cartridge 1 comprises, inside the main body thereof, a transporter 5 for transporting the toner, and the like.

The rotary 2 is constituted using a flexible member, and comprises a rotary shaft 2*a* and a plate shaped agitator 3, which extends in the axial direction of the rotary shaft 2*a*. The agitator 3 herein consists of a flexible film, such as polyethylene and polyethylene terephthalate, which is arranged so that it disperses [toner] in the axial direction, and is connected to and supported by the rotary shaft 2*a* via a plate shaped support 4 provided orthogonal to the axial direction. In detail, two agitators 3 are provided to the rotary shaft 2*a*, and these agitators 3 are rectangularly formed and connected to a plurality of plate shaped supports 4 at the long side edges of the agitators 3. The plate shaped supports 4 are formed substantially disc shaped. The two agitators 3 are disposed at opposing positions about the rotary shaft 2*a* in the radial direction, and both are connected to the substantially central plate shaped support 4 so that parts of the agitators 3 overlap in the axial direction.

The rotary 2 comprises an engager 8 that is formed in a hook shape at the shaft end 6. In detail, the engager 8 is formed so that two hooks 8*a*, 8*b* at the tip of the engager 8 oppose one another about the rotary shaft 2*a*. The hooks 8*a*, 8*b* are constituted elastic and deformable inwardly from the diameter of an engaging hole 11 of a retainer 10, which is formed in the bearing 7. A surface on the hook 8*a* that is orthogonal to the rotary shaft 2*a* of the rotary 2 constitutes a contact part 9*a*, and likewise a surface on the hook 8*b* that is orthogonal to the rotary shaft 2*a* constitutes a contact part 9*b*. In a state wherein the engager 8 is inserted through the engaging hole 11 of the retainer 10, these contact parts 9*a*, 9*b* contact the retainer 10 and inhibit the shaft end 6 from slipping out of the bearing 7 when a force acts upon the rotary 2 in a direction so that the engager 8 slips out from the retainer 10. In addition, the engager 8 is formed so that the spacing between the tips of the hooks 8*a*, 8*b* is set smaller than the diameter of the engaging hole 11 formed in the retainer 10, the spacing of the outline portion gradually increases toward the contact parts 9*a*, 9*b*, and the spacing of the outline portion of the contact parts 9*a*, 9*b* is greater than the diameter of the engaging hole 11. By forming [the engager 8] in this manner, the outer diameter parts of the contact parts 9*a*, 9*b* from the tips of the hooks 8*a*, 8*b* serve the function of a guide when inserting the engager 8 into the retainer 10, which makes it easier to engage the engager 8 to the retainer 10.

Here, in the present embodiment, a spacing t between the tips of the hooks 8*a*, 8*b* is set to substantially 3.4 mm, and a diameter d of the rotary shaft 2*a* is set to substantially 5.9 mm. In addition, in the state wherein the shaft end 6 of the rotary 2 is engaged to the bearing 7, the gap w between the contact parts 9*a*, 9*b* of the engager 8 and a contact surface 12 of the retainer 10 when the rotary 2 is in the normal state is set to substantially 2.5 mm in the present embodiment. Furthermore, the spacing between the contact parts 9*a*, 9*b* of the engager 8 and the contact surface 12 of the retainer 10 is set to an appropriate value that takes into consideration the ease of assembly, the fixing accuracy, and the like, of the rotary 2.

Figure 3:
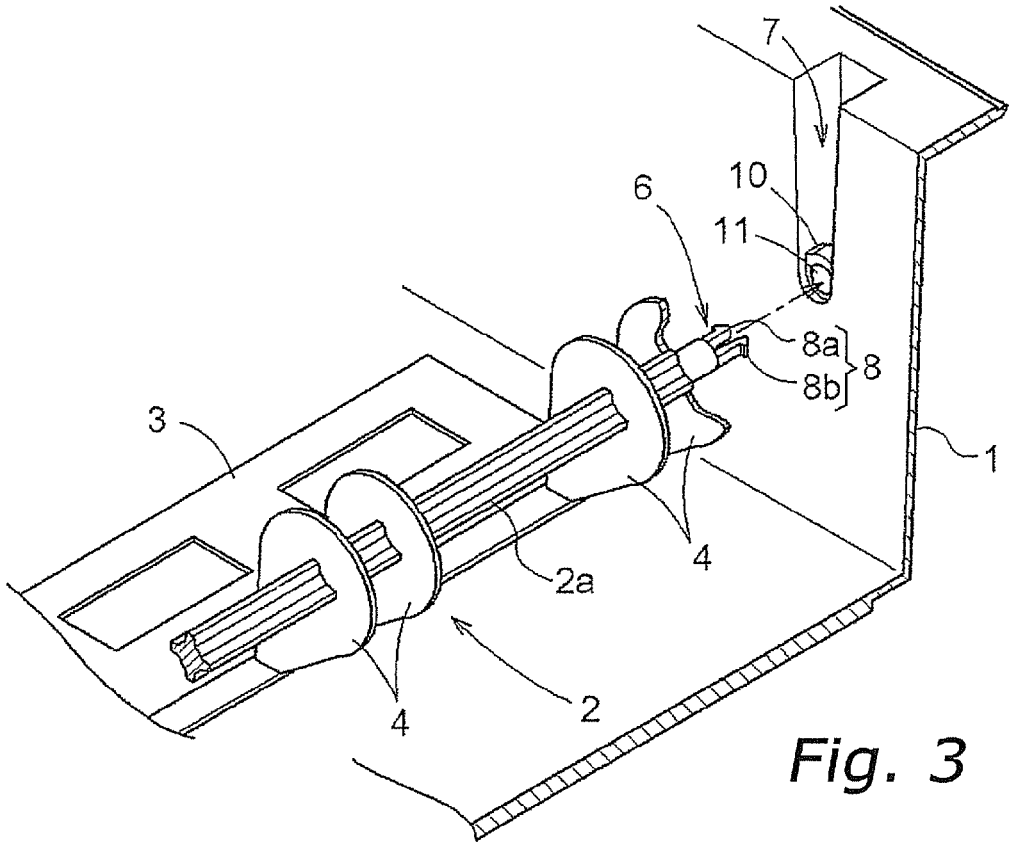
FIG. 3 is an oblique view of the principal parts of the first embodiment of the toner cartridge according to the present invention.
Figure 4:
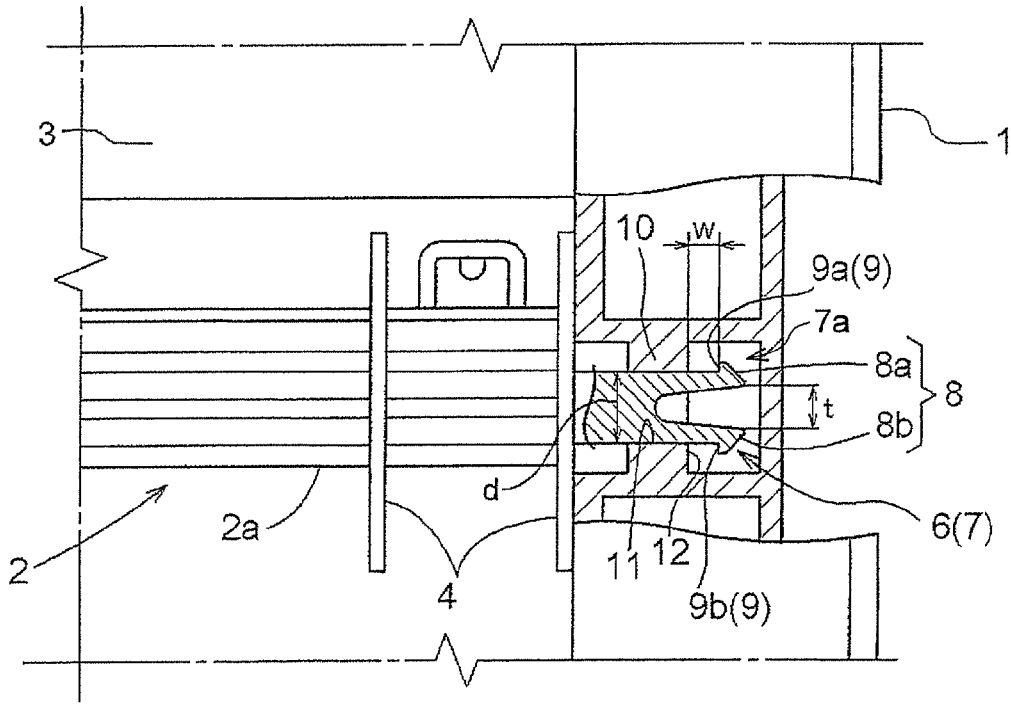
FIG. 4 is a cross sectional view of the principal parts of the first embodiment of the toner cartridge according to the present invention.

As depicted in FIG. 3 and FIG. 4, the bearing 7 is formed substantially pocket shaped, and, in the vicinity of the inner side of the opening thereof, a plate shaped retainer 10, comprising an engaging hole 11 for inserting the engager 8 therethrough, is integrally formed with the main body. The bearing 7 is formed inside the main body of the toner cartridge 1, and the toner does not leak because the bearing 7 does not pass through to the outside. The thickness of the retainer 10 is set to 5 to 6 mm. The diameter of the engaging hole 11 is set in accordance with the diameter of the rotary shaft 2*a* and to a size that ensures that the engager 8 can rotate in its engaged state. In the present embodiment, [the diameter of the engaging hole 11] is set to substantially 6.1 mm. Furthermore, the surface of the retainer 10 in the insertion direction of the engager 8 is constituted as a contact surface 12 that contacts the contact parts 9*a*, 9*b* formed in the engager 8.

The engagement of the engager 8 to the retainer 10 is accomplished by inserting the two hooks 8*a*, 8*b* of the engager 8 through the engaging hole 11, while mutually compressing and deforming them inwardly. Once the engager 8 is inserted through the engaging hole 11, the hooks 8*a*, 8*b* thereof undeform and return to the normal position. In the state wherein [the engager 8 is] inserted through the engaging hole 11, the contact parts 9*a*, 9*b* of the engager 8 contact the contact surface 12 of the retainer 10 and inhibit the slipping out of the engager 8 from the retainer 10, even if the rotary 2 flexes and deforms and the shaft end 6 moves in the axial direction.

Furthermore, in the present embodiment, the engager 8 is provided with two hooks 8*a*, 8*b*, but hooks of an appropriate number and shape are constituted in accordance with: the material, shape, and the like, of the rotary 2; the constitution of the bearing 7; and so on.

Other Embodiments

Figure 5:
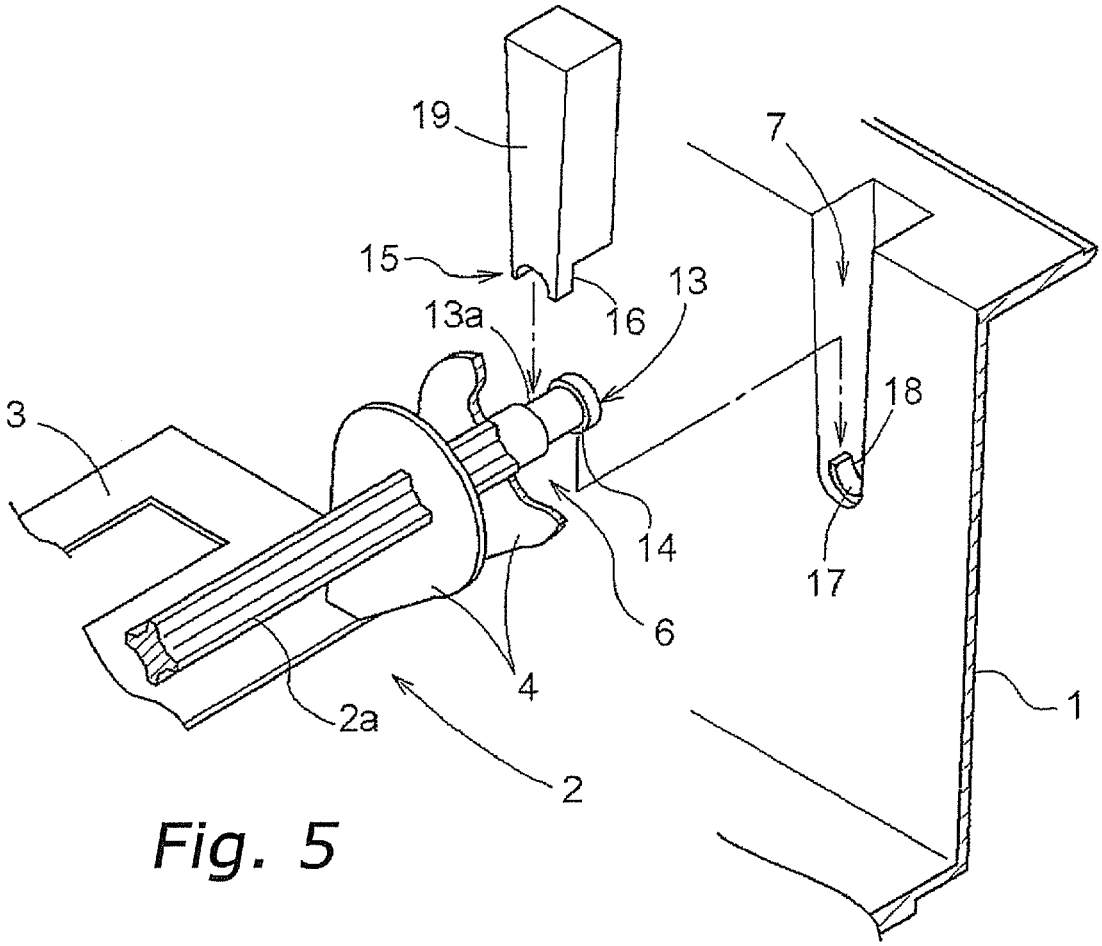
FIG. 5 is an oblique view of the principal parts of another embodiment of the toner cartridge according to the present invention.
Figure 6:
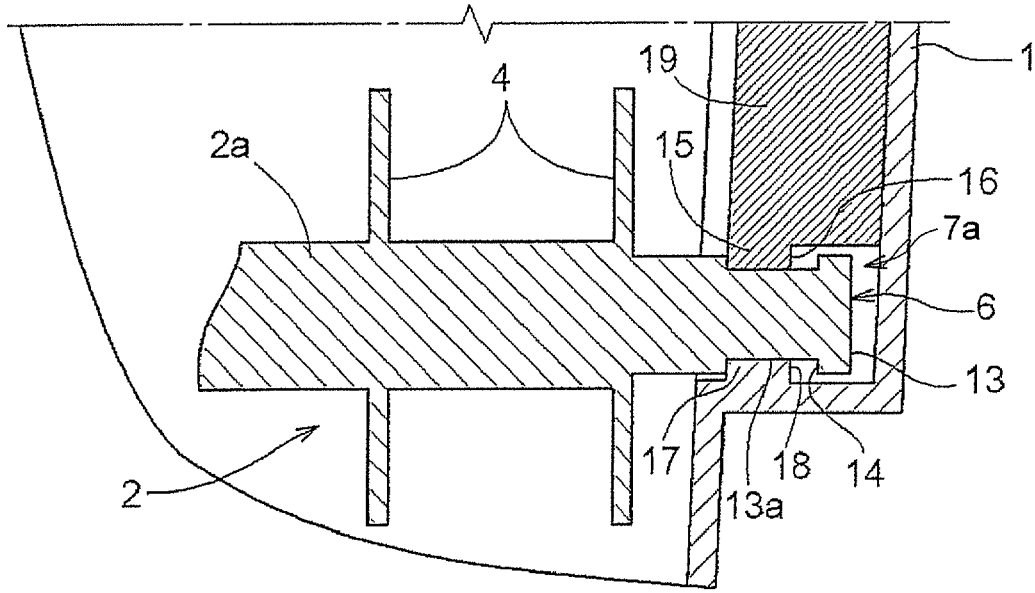
FIG. 6 is a cross sectional view of the principal parts of another embodiment of the toner cartridge according to the present invention.

The following explains another embodiment of the toner cartridge 1 according to the present invention, referencing FIG. 5 and FIG. 6.

In the first embodiment, the hooks 8*a*, 8*b* are provided at the shaft end 6 of the rotary 2 to form the engager 8, and the bearing 7 is provided with a plate shaped retainer 10; however, in the present embodiment, a retainer 15 is provided to a cover 19.

As an engager 13, a groove 13*a* is formed in the rotary 2 of the present embodiment in the circumferential direction at a position of a fixed distance from the tip of the shaft end 6. This groove 13*a* is formed so that a side surface on the tip side is orthogonal to the axial direction of the rotary shaft 2*a*, and constitutes a contact part 14 with respect to the retainer 15.

The retainer 15 of the present embodiment is integrally formed with the cover 19, and is constituted as a presser that presses the engager 13 from the mounting direction of the cover 19 in the mounted state. In detail, a contact surface 16 is formed in the retainer 15 that contacts the contact part 14 of the groove 13*a*, which is formed in the engager 13, when the cover 19 is positioned inside the groove 13*a* in the mounted state and when a force acts upon the rotary 2 so that the engager 13 slips out of the retainer 15.

Furthermore, in the present embodiment, a retainer 17 is formed in the bearing 7 as a presser that presses the engager 13 from the side opposite the mounting direction of the cover 19, and is positioned at the groove 13*a* of the engager 13, in a state wherein the engager 13 is engaged to the bearing 7. In addition, a contact surface 18 is formed in the retainer 17, the same as the retainer 15. Therefore, both the contact surface 16 of the retainer 15 and the contact surface 18 of the retainer 17 contact the contact part 14 of the engager 13, and, consequently, the slipping out of the shaft end 6 from the bearing 7 is reliably inhibited.

Furthermore, the width of each of these retainers 15, 17 in the axial direction is set narrower than the groove 13*a* of the rotary shaft 2*a* in the axial direction, and takes into consideration the ease of assembly, fixing accuracy, and the like. In so doing, a toner cartridge 1 can be obtained, wherein the shaft end 6 of the rotary 2 does not slip out from the bearing 7 and the ease of assembly is not adversely impacted, the same as in the first embodiment.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A rotary support structure in a main body for agitating toner comprising:

a rotary having a rotary shaft and an agitator configured to agitate toner and arranged on an outer periphery of the rotary shaft; and a bearing formed in the main body configured to rotatably support one end portion of the rotary shaft, the bearing including a first supporting portion and a second supporting portion separate from and detachably coupled to the first supporting portion, the first supporting portion being configured to support a lower side portion of the one end portion of the rotary, the second supporting portion being configured to support an upper side portion of the one end portion of the rotary shaft.

2. The rotary support structure according to claim 1, wherein the rotary is provided with an engager on the one end portion of the rotary shaft, and the bearing has a retainer configured to restrict movement of the engager in the axial direction.

3. The rotary support structure according to claim 2, wherein the engager is formed on the tip of the one end of the rotary, and has a large-diameter portion being larger in width than the one end portion supported by the bearing, the retainer has contact faces that contact the engager and restrict movement of the rotary in the axial direction.

4. The rotary support structure according to claim 3, wherein the second supporting portion is detachably coupled to the bearing.

5. The rotary support structure according to claim 1, wherein the bearing further includes a groove having an open surface and a closed surface in the axial direction and an open end and a closed end in longitudinal direction, the first supporting portion being positioned at the closed end.

6. The rotary support structure according to claim 5, wherein the second supporting portion being inserted into the groove by way of the open end.

7. The rotary support structure according to claim 6, wherein the cross section of the groove gradually increases from the closed end to the open end.

8. The rotary support structure according to claim 5, wherein the groove has a substantially extended semi-oblong shape.

9. A toner cartridge comprising:

a rotary having a rotary shaft and an agitator being configured to agitate toner and arranged on an outer periphery of the rotary shaft; and a bearing formed in a main body of the toner cartridge and configured to rotatably support one end portion of the rotary shaft, the bearing including a first supporting portion and a second supporting portion separate from and detachably coupled to the first supporting portion, the first supporting portion being configured to support a lower side portion of the one end portion of the rotary, the second supporting portion being configured to support an upper side portion of the one end portion of the rotary shaft.

10. The toner cartridge according to claim 9, wherein the rotary is provided with an engager on the one end portion of the rotary shaft, and the bearing has a retainer configured to restrict movement of the engager in the axial direction.

11. The toner cartridge according to claim 10, wherein the engager is fanned on the tip of the one end of the rotary, and has a large-diameter portion being larger in width than the one end portion supported by the bearing, the retainer has contact faces that contact the engager and restrict movement of the rotary in the axial direction.

12. The toner cartridge according to claim 11, wherein the second supporting portion is detachably coupled to the bearing.

13. The toner cartridge according to claim 9, wherein the bearing further includes a groove having an open surface and a closed surface in the axial direction and an open end and a closed end in longitudinal direction, the first supporting portion being positioned at the closed end.

14. The toner cartridge according to claim 13, wherein the second supporting portion being inserted into the groove by way of the open end.

15. The toner cartridge according to claim 14, wherein the cross section of the groove gradually increases from the closed end to the open end.

16. The toner cartridge according to claim 13, wherein the groove has a substantially extended semi-oblong shape.

* * * * *